US006103440A

United States Patent [19]

Lohr

[11] Patent Number: 6,103,440

[45] Date of Patent: Aug. 15, 2000

[54] TONER COMPOSITION AND PROCESSES THEREOF

[75] Inventor: Robert L. Lohr, Fairport, N.Y.

[73] Assignee: Xerox Corporation, Stamford, Conn.

[21] Appl. No.: 09/072,476

[22] Filed: May 4, 1998

[51] Int. Cl.[7] ..... G03G 9/00

[52] U.S. Cl. ..... 430/110; 430/111

[58] Field of Search ..... 430/109, 110, 430/111, 106, 106.6

[56] References Cited

U.S. PATENT DOCUMENTS

| | | | |
|---|---|---|---|
| 3,900,588 | 8/1975 | Fisher | 427/19 |
| 4,395,485 | 7/1983 | Kashiwagi et al. | 430/903 |
| 4,517,268 | 5/1985 | Gruber et al. | 430/106.6 |
| 4,626,487 | 12/1986 | Mitsuhashi et al. | 430/110 |
| 4,748,474 | 5/1988 | Kurematsu et al. | 355/15 |
| 4,933,251 | 6/1990 | Khimura et al. | 430/109 |
| 5,077,170 | 12/1991 | Tsujihiro | 430/110 |
| 5,079,123 | 1/1992 | Nanya et al. | 430/106.6 |
| 5,114,821 | 5/1992 | Haack | 430/110 |
| 5,141,833 | 8/1992 | Kitamori et al. | 430/110 |
| 5,437,955 | 8/1995 | Michlin | 430/110 |
| 5,486,443 | 1/1996 | Grande et al. | 430/110 |
| 5,504,559 | 4/1996 | Ojima et al. | 430/110 |
| 5,552,252 | 9/1996 | Lundy et al. | 430/110 |

OTHER PUBLICATIONS

Caplus Abstract AN 1985: 176467 of JP 59–200250 (Pub Nov. 13, 1984).

*Primary Examiner*—John Goodrow
*Attorney, Agent, or Firm*—John L. Haack

[57] ABSTRACT

A toner including a resin, a colorant, and acrylate polymer particles on the surface of the toner.

12 Claims, No Drawings

TONER COMPOSITION AND PROCESSES THEREOF

REFERENCE TO ISSUED PATENTS

Attention is directed to commonly owned and assigned U.S. Pat. Nos Compositions With Silica, Strontium Titanate and Polyvinylidene Fluoride", and which patent discloses a toner comprised of resin particles, magnetite, carbon black, rhodamine charge additive, wax, and a surface mixture of silica, strontium titanate and polyvinylene fluoride; and U.S. Pat. No. 5,482,805, issued Jan. 9, 1996, entitled "Magnetic Toner Compositions with Aluminum Oxide, Strontium Titanate and Polyvinylidene Fluoride".

The disclosures of each the above mentioned patents are incorporated herein by reference in their entirety. The appropriate components and processes of these patents may be selected for the toners and processes of the present invention in embodiments thereof.

BACKGROUND OF THE INVENTION

The present invention is generally directed to improved toner compositions and imaging processes thereof. The imaging processes of the present invention provide toners and methods of preventing or eliminating background and spotted images which spots are believed to arise from uncharged or oppositely charged surface additive particulates or agglomerates thereof which contain small amounts of colorant material sufficient to impart objectionable color and noticeable appearance to random background deposits.

The toner compositions of the present invention in embodiments thereof possess excellent admix characteristics, maintain their triboelectric charging characteristics for an extended number of imaging cycles, and enable the elimination or minimization of undesirable background deposits or spots on the imaging member or photoconductor, and the image receiver sheet or copy paper. Furthermore, the toner compositions of the present invention are substantially insensitive to relative humidity in a machine environment and permit developed images with excellent optical densities and low background. Developers of the present invention are comprised of the aforementioned toners and carrier particles, especially carrier particles comprised of a core with a mixture of polymers thereover. The toner and developer compositions of the present invention can be selected for electrophotographic, especially xerographic, imaging and printing processes and preferably magnetic image character recognition processes (MICR) such as processes similar to those selected for the Xerox Corporation 8790/9790 MICR machines, and preferably the Xerox Corporation 4135® MICR test fixture or machine, and wherein for example, personal checks with no, or minimal background deposits can be generated.

PRIOR ART

U.S. Pat. No. 3,900,588, issued Aug. 19, 1975, to Fisher et al., discloses an imaging technique and composition for developing electrostatographic latent images whereby a developer composition is employed comprising toner, a substantially smearless polymeric additive like KYNAR®, and an abrasive material surface additive such as silica, like AEROSIL R972®, or strontium titanate, see column 7, lines 12 to 17.

U.S. Pat. No. 5,437,955, issued Aug. 1, 1995, to Michlin, discloses a dry toner composition for electrophotography including a binder resin, a coloring agent and a mica-group mineral, which mineral provides the toner composition with lubricity and better flow capabilities. The mica-group mineral is wet ground and may be coated with calcium stearate to reduce static electricity generated during operation of the electrophotographic machine.

U.S. Pat. No. 4,395,485, issued Jul. 26,1983, to Kashiwage, et al., discloses a one component type dry developer for electrophotography which is improved on humidification, and consists of a mixture of toner with a particle size of about 5 to 50 microns and a hydrophobic flow agent. The flow agent is made by coating inorganic, organic, metallic or an alloy powder with a thin film of non-hydrophilic synthetic resin. A flow agent having non-hydrophilic and electrically conductive properties is obtained.

U.S. Pat. No. 4,748,474, issued May 31, 1988, to Karematusu, et al., discloses an imaging forming method and apparatus using an image bearing member, movable along an endless path, for bearing a toner image and having a critical surface tension of not more than 33 dyne/cm, wherein the toner image formed on the image bearing member by a developer containing toner not less than 70% of which has a particle size of 1–5 microns, and lubricant in an amount not less than 0.5% by weight of the toner, and the image bearing member is cleaned by removing the toner image remaining on the image bearing member.

U.S. Pat. No. 5,079,123, issued Jun. 7, 1992, to Nanya, et al., discloses a dry-type toner for electrophotography comprising a binder resin, a coloring agent, and, as a lubricant, a carnauba wax substantially free of free aliphatic acids. The toner may further comprised a magnetic material, and the resulting toner mixture can be used as a magnetic toner.

The aforementioned patents are incorporated in their entirety by reference herein.

Other patents of interest follow. Toners and developers with surface additives of metal salts of fatty acids like zinc stearate and silica are known, reference for example U.S. Pat. Nos. 3,983,045 and 3,590,000. The commonly owned and assigned U.S. Pat. No. 3,983,045, issued Sep. 28, 1976, to Jugle et al., discloses a developer composition comprising 1) electroscopic toner particles, 2) a friction-reducing material, such as fatty acids, metal salts of fatty acids, fatty alcohols, fluorocarbon compounds, polyethylene glycols, and the like, of a hardness less than the toner and having greater friction-reducing characteristics than the toner material, and 3) a finely divided nonsmearable abrasive material, such as, colloidal silica, surface modified silica, titanium dioxide, and the like metal oxides, of a hardness greater than the friction-reducing and toner material. In U.S. Pat. No. 4,789,613, there is illustrated a toner with an effective amount of, for example, strontium titanate dispersed therein, such as from about 0.3 to about 50 weight percent. Also disclosed in the '613 patent is the importance of the dielectric material with a certain dielectric constant, such as strontium titanate, being dispersed in the toner and wherein the surface is free or substantially free of such materials. Further, this patent discloses the use of known charge controllers in the toner, see column 4, line 55, olefin polymer, see column 5, line 35, and a coloring agent like carbon black as a pigment. Treated silica powders for toners are illustrated in U.S. Pat. No. 5,306,588. Toners with waxes like polypropylene and polyethylene are, for example, illustrated in U.S. Pat. Nos. 5,292,609; 5,244,765; 4,997,739; 5,004,666 and 4,921,771, the disclosures of which are totally incorporated herein by reference. Magnetic toners with low molecular weight waxes and external additives of a first flow aid like silica and metal oxide particles are illustrated in U.S. Pat. No. 4,758,493, the disclosure of which is totally incorporated herein by reference. Examples of metal oxide surface additives are illustrated in column 5, at line 63, and include strontium titanate. Single component magnetic toners with silane treated magnetites are illustrated in U.S. Pat. No. 5,278,018, the disclosure of which is totally incorporated herein by reference. In column 8 of the '018 patent, there is disclosed the addition of waxes to the toner and it is indicated that surface additives such as AEROSIL®, metal salts of fatty acids and the like can be selected for the toner. Magnetic image character recognition processes and toners with magnetites like MAPICO BLACK® are known, reference for example U.S. Pat. No. Re. 33,172, the disclosure of which is totally incorporated herein by reference, and U.S. Pat. No. 4,859,550. The 33,172 patent also discloses certain toners with AEROSIL® surface additives. The toners and developers of the present invention may in embodiments be selected for the MICR and xerographic imaging and printing processes as illustrated in the 33,172 patent. Moreover, toners with charge additives are known. Thus, for example, there is described in U.S. Pat. No. 3,893,935, the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorate, tetrafluoroborate, benzene sulfonate, and the like; U.S. Pat. No. 4,221,856, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112, wherein A is an anion including, for example, sulfate, sulfonate, nitrate, borate, chlorate, and the halogens. Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 4,394,430 and 4,560,635, which illustrates a toner with a distearyl dimethyl ammonium methyl sulfate charge additive. Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, TRH as a charge additive is illustrated in a number of patents, such as U.S. Pat. No. 5,278,018, the disclosure of which is totally incorporated herein by reference.

There remains a need for toners and developer compositions with improved image quality and reduced image distortion and background deposits. There also remains a need for toners with, for example, superior flow, environmental stability, and charging properties, and imaging processes thereof, and which toners are substantially insensitive to relative humidity, possess excellent admix characteristics, stable $A_t$ properties, no evidence of background deposits when the toner is selected for the development of images after about 1 million imaging cycles, or when the toner is tested in an aging fixture for more than about 100 hours, and which toners are useful for the development of electrostatic latent images, or which toners can preferably be selected for MICR methods, and wherein personal checks with no or minimal background deposits are generated.

The aforementioned and other advantages are achievable with the toners and processes of the present invention. The compositions and processes of the present invention are useful in many applications including printing, for example, particulate based ink jet and electrostatographic, such as in xerographic printers and copiers, including digital systems.

SUMMARY OF THE INVENTION

Embodiments of the present invention, include:

overcoming, or minimizing deficiencies of the prior art, by providing toner compositions and imaging processes thereof; and providing:

a toner comprised of a resin, a colorant, and acrylate polymer particles, such as polymethylmethacrylate, on the surface of the toner;

a process comprising mixing a toner comprising a resin, a colorant, and acrylate polymer particles on the surface of the toner, wherein the machine toner concentration (TC) latitude of the toner composition is increased by about 2 to about 3.5 units within the range of about 1 to about 6 units compared to a toner without the acrylate polymer particles on the surface of the toner; and an imaging process comprising depositing a toner comprised of a resin, a colorant, and acrylate polymer particles on the surface of the toner, onto a charged image receiving member, and wherein the resulting images are free of background deposits or fog and have improved image quality.

DETAILED DESCRIPTION OF THE INVENTION

The composition and processes of the present invention provide, in embodiments: a toner comprised of a resin, a colorant, and acrylate polymer particles, such as polymethylmethacrylate, on the surface of the toner, and preferably uniformly distributed on the surface of the toner. The toner compositions of the present invention, in embodiments, provide beneficial properties, such as improved machine toner concentration latitude, and wherein the surface additive particles, or incidentally formed agglomerates of the surface additive particles and small amounts of other toner constitutents, tend to selectively deposit on negatively charged image areas of the photoreceptor and thereby improve image quality by reducing the background deposits appearing in non-image or uncharged areas on the photoreceptor surface. Other advantages of the toner compositions of the present invention which follow from the presence of the polyacrylate surface additive include, for example, reduced random machine dirt, improved cleaning efficiency and component life, reduced cleaning system failures, increased prints per pound of developed toner, and the like.

The acrylate polymer particles can be, for instance, polyacrylate polymers, polyacrylate copolymers, or mixtures thereof, for example, polyacrylic acid, polyacrylic acid esters, and alkyl substituted polyacrylic acids and polyacrylate esters, such as polyalkylacrylates, polyalkylmethacrylates, polyalkylethacrylates, and the like polymers, wherein the alkyl group or ester group of the acrylate monomer has from 1 to about 10 carbon atoms, and wherein the alkyl substituted polyacrylates can have from 1 to about 3 substitutents appended to the acryl moiety wherein the substitutents can each contain from 1 to about 10 carbon atoms. A preferred acrylate polymer selected for the polymeric particles is polymethylmethacrylate of the formula $—(CH_2—CH(Me—CO_2—Me)_n—$ wherein Me is methyl and n is an integer representing the approximate number of methyl methacrylate mers in the polymer and can be, for example, from about 800 to about 5,000.

Although not wanting to be limited by theory, the toner compositions of the present invention possess improved image quality that is believed to arise from the positively charging polymeric particulate surface additive's ability to "print out" in negatively charged image areas rather than in non-image areas and thereby reduces or eliminates non-image background deposits. The polymethylmethacrylate (PMMA) particles, or agglomerates thereof, while being electrostatically associated with the toner surface, that is not permanently affixed to the toner particle surface, can be attracted to negatively charged or image areas on the photoreceptor and not the background, hence background deposits arising from colored PMMA particles or agglomerates are substantially reduced or eliminated and image quality is increased accordingly.

The following is addressed to an exemplary surface additive particulate material; polymethylmethacrylate. It believed that the disclosure is equivalently applicable to other positively charging polymer particles, including the aforementioned polyacrylate polymers. The polymethylmethacrylate particles, in embodiments, can have a volume average diameter from about 0.25 to about 0.75, and preferably from about 0.36 to about 0.50 microns as measured by a Coulter Counter. A nominal or average particle size is about 0.44 microns, for example, as in MP116 commercially available PMMA particles from Soken Chemical, and as disclosed in the aforementioned commonly owned and assigned U.S. Pat. No. 5,486,443, the disclosure of which is incorporated by reference herein in its entirety.

The polymethylmethacrylate particles are believed to electrostatically adhere to the surface of the toner particles, and are believed to be positively charging, for example, from about 10 to about 40 microcoulombs/gram, and wherein the level of charging is a function of the concentration and the carrier selected, for example, the PMMA particles of the present invention at about 1.0 weight percent with respect to a Xerox Corporation Model 5090® carrier provides a tribocharge of about 20 microcoulombs/gram. The polymethylmethacrylate particles are preferably substantially spherical in shape, and preferably have a substantially macroscopically smooth surface character.

The toner particles of the present invention can be any conventional resin based toner which possesses a volume average diameter particle size, for example, from about 1 to about 40 microns, preferably from about 8 to about 20 microns, and more preferably from about 8 to about 13 microns. Toners of the present invention also include small toners suitable for use in high fidelity color imaging processes, for example, with a volume average diameter particle size of from about 2 to about 7 microns.

The weight ratio of the toner particles to the acrylate particles can be from about 1,000:1 to about 10:1. The polymethylmethacrylate particles can be present in amounts from about 0.1 to about 1.0 weight percent based on the total weight of the toner, preferably from about 0.25 to about 0.75 weight percent, and most preferably from about 0.3 to about 0.7 weight percent based on the total weight of the toner.

The toner resin can be styrene-butadienes, styrene-acrylates, styrene-alkacrylates, polyesters, and the like polymers, and mixtures thereof. A preferred resin is a styrene-butadiene copolymer, for example, PLIOTONE® commercially available from Goodyear Co., with weight average molecular weights, for example, from about 94,000 to about 420,000, and preferably from about 100,000 to about 400,000, and a glass transition temperature (Tg) of about 127 to about 140° F. and preferably from about 128° F. to about 130° F. The resin or resins selected for the toner compositions of the present invention can be, for example, extruded, non extruded, and physical or melt mix mixtures thereof.

The colorant can be, for example, known dyes or pigments, and the like materials and mixtures thereof. When a pigment is selected as the colorant it is present, for example, in amounts from about 2 to about 10 weight percent based on the weight of the toner. The colorant can be a pigment, for example, a carbon black, a magnetite, a cyan pigment, a magenta pigment, a yellow pigment, a red pigment, a green pigment, a blue pigment, a brown pigment, or mixtures thereof. The colorant can be, in embodiments, a mixture of two or more colorants, such as 6 weight percent carbon black and 30 weight percent magnetite, based on the total weight of the toner composition.

The toner compositions of the present invention can further comprise charge additives, for example, present in amounts of from about 0.05 to about 5 weight percent, and preferably present in amounts of from about 0.1 to about 3 weight percent. A positive or a negative charge additive, or mixtures thereof may be selected providing that the resulting toner has a net positive charging characteristic. Thus, various known external additives in various amounts may be included in formulating toner of the present invention and their relative amounts balanced so as to achieve a toner composition which has a net positive charging character.

Flow additives include, for example, a hydrophobically treated silica, such as H2050 EP, a positively charging silica, commercially available from Wacker-Silicones Corp., and strontium metal oxide compounds, such as strontium titanate, which can act as a flow aid in providing free flowing positively charging toner compositions. The toner has cohesion flow values, for example, from about 5 to about 10 percent as measured with a Hosokawa Powder Tester, which values indicate that the toners are free flowing powders with no tendency to cake or block.

Toner compositions of the present invention, in embodiments, have admix times of from less than about 15 seconds, or an admix time of from about 1 to about 14 seconds, and with triboelectric charge of from about 10 to about 40 microcoulombs per gram as determined by a charge spectrograph.

Toner compositions of the present invention, in embodiments, can further comprise a wax additive with a weight average molecular weight of from about 1,000 to about 20,000, wherein the wax is preferably integral, that is, in intimate admixture, with the bulk toner. The wax is preferably not a surface additive, and the wax can be, for example, polyethylene, polypropylene, aliphatic alcohols, mixtures thereof, and the like compounds.

Toner compositions of the present invention, in embodiments, can have machine toner concentration latitudes (TCL) measured by machine test operating latitude wherein a lower TC (toner concentration) boundary relates to the solid area density and an upper TC boundary relates to background. Samples of the machine test developer mixture, for example, with a PMMA containing toner, is bench tested to determine the machine operating toner concentration. The TCL is the toner concentration (TC) range required to remain within established solid area density and the background requirements. The latitude is about 5.0 units, the difference between from about 1.0 TC to about 6.0 TC. The toner concentration latitude (TCL) is a machine-development performance measure, and not a property of the toner alone or by itself. Rather toner concentration latitude represents the toner functioning in an operating space between acceptable solid area density (SAD) performance and background (BKG) deposit performance. Thus, it is desirable to have a wide toner concentration latitude with the low TC limit relating to solid area density and a high TC limit relating to background deposit, or alternatively, it is desirable to maximize the total TCL value, that is, the larger the difference between BKG TC limit and SAD TC limit the higher the print quality of the resulting images. In comparison, reference the Comparative Example I, where an equivalent toner with the exception that KYNAR® surface particles were employed in place of PMMA surface particles of the present invention, there resulted toner concentration limits of about 2.0 (SAD) and about 3.5 (BKG), for a total TCL of about 1.4. Thus with toners and processes of the present invention there was achieved a total TCL in the range of about 4 to about 5 units compared to a TCL in the range of about 1 to about 1.5 units for a toner without polymethylmethacrylate particles on the surface of the toner.

The toners of the present invention, including toner particles and polymethylmethacrylate surface additive particles, cleanly and selectively deposit on negatively charged image areas of the electrophotoconductive receiver member and do not deposit, or there may be a minimum nonconsequential deposit in uncharged, and non-image or background areas of the receiver imaging member.

Although not wanting to be limited by theory it is believed that, in embodiments, the combination toner particles and polymethylmethacrylate particles of like or dissimilar charge reduces the amount of oppositely charged free particulate additive that can potentially deposit on the imaging member in non image areas as dirt or extraneous debris thereby creating image defects and causing diminished image quality.

The toner composition of the present invention can be comprised of, for example, a styrene-butadiene copolymer resin with a weight average molecular weight of about 100,000 to about 400,000, wherein the colorant comprises a mixture of 6 weight percent carbon black and 30 weight percent magnetite based on the total weight of the toner composition, wherein the toner has a net positive charging character, a flow aid compound, such as, H2050 EP a hydrophobic positively charging silica, from Wacker-Chemie GmbH HDK®, strontium titanate in an amount of from about 0.5 to about 2 weight percent, a release agent wax that is integral with the bulk toner, and a machine toner concentration latitude of about 2.0 to about 3.0 units.

In embodiments the resin particles can be a styrene-butadiene polymer in an amount of from about 55 to about 70 weight percent, the colorant can be, for example, a mixture of an acicular magnetite in an amount of from about 27 to about 34 weight percent and carbon black in an amount of from about 2 to about 3 weight percent, a quaternary ammonium salt charge additive in an amount of from about 0.7 to about 1.5 weight percent, a low molecular weight wax with a weight average molecular weight of from about 1,000 to about 3,000 present in an amount of from about 4.5 to about 6 weight percent, and the surface of the toner particles can be a mixture of silica in an amount of from about 0.75 to about 1.0 weight percent, strontium titanate in an amount of from about 0.5 to about 1.25 weight percent, and polymethylmethacrylate surface additive particles in an amount of from about 0.25 to about 0.75 weight percent based on the total weight of the toner.

The present invention, in embodiments, encompasses developer compositions comprised of coated carrier particles comprising a core with a coating thereover comprised of at least one polymer, and a toner composition comprised of toner resin particles and colorant, especially pigment particles, and polymethylmethacrylate particles or resin particles of equivalent shape, size, charge, and flow properties.

Toner compositions can be prepared by a number of known methods, such as admixing and heating resin particles such as styrene butadiene copolymers, colorant particles such as magnetite, carbon black, or mixtures thereof, and cyan, yellow, magenta, green, brown, red, or mixtures thereof, and preferably from about 0.5 percent to about 5 percent of charge enhancing additives in a Banbury apparatus and rubber ill, and removing the formed toner composition from the device. Subsequent to cooling, the toner composition is subjected to grinding utilizing, for example, an AFG grinder for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene-butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable colorants, such as pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Colorant includes pigments, dyes, mixtures thereof, mixtures of pigments, mixtures of dyes, and the like.

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-150® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount from about 2 percent to about 10 percent by weight and may in embodiments function as fuser roll release agents.

Encompassed within the scope of the present invention are colored toner and developer compositions comprised of toner resin particles, carrier particles, charge enhancing additives, and as pigments or colorants red, blue, green, brown, magenta, cyan and/or yellow particles, as well as mixtures thereof. More specifically, with regard to the generation of color images utilizing a developer composition with charge enhancing additives, illustrative examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts such as from about 2 percent by weight to about 15 percent by weight calculated on the weight of the toner resin particles, or alternatively, by weight calculated based on the total weight of the toner.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments, about 77 to about 150 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 100 parts to about 200 parts by weight of carrier are selected.

The toner composition used in conjunction with the coated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably 30 possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow positive or negative charge distributions, optimal charging triboelectric values, preferably of from about 10 to about 35, and more preferably from about 10 to about 30 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

COMPARATIVE EXAMPLE I

KYNAR® AND OTHER NON-PMMA PARTICULATES AS SURFACE ADDITIVES.

There was prepared a toner by melt blending in a Banbury apparatus and rubber mill, followed by mechanical attrition, which toner contains 61.75 percent by weight of a styrene-butadiene copolymer containing 90 percent by weight of styrene and 10 percent by weight of butadiene obtained from Goodyear Chemicals Corporation as PLIOTONE®, and 29 percent by weight of the acicular magnetite MAGNOX B-353®, the highly crystalline polyethylene wax POLY-WAX 2000®, as obtained from Petrolite Corporation and of a density greater than 0.93 gram/cc in an amount of 5.25 percent by weight, 1.0 percent by weight of the charge control agent FANAL PINK 4830®, the phosphomolybdate salt of rhodamine obtained from BASF, and 3 percent by weight of REGAL 330®. carbon black obtained from Cabot Corporation. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 to 11 microns. Subsequently, there was added to the resulting toner particles surface by blending in a Lodige blender, 1.0 percent by weight of Wacker-Chemie GmbH HDK® H2050 EP hydrophobic positively charging silica, 0.5 percent by weight of strontium titanate, obtained from Ferro Corporation (CODE 218), and 0.5 percent by weight of polyvinylidene fluoride, KYNAR 201®, obtained from Atochem, Inc. of North America. There was prepared a developer composition by mixing the aforementioned formulated toner composition at 3.0 percent toner concentration, that is 3 parts by weight of toner per 100 parts by weight of carrier, with carrier comprised of an iron core, obtained from Hoganaes Corporation, with 0.6 weight percent of a polymeric coating mixture of KYNAR 201®, and polymethylmethacrylate in ratio of 48 weight percent of KYNAR®, and 52 weight percent of polymethylmethacrylate (PMMA). Triboelectric charging of the toner in the aforementioned developer was determined by shaking in a paint mixer 100 grams of the developer in an 8 ounce jar for fifteen minutes, then measuring the charge on the toner in a Faraday Cage apparatus. The charge on the toner was determined to be a positive 23 microC/gram. To the developer was then added an additional 1.0 weight percent of toner and the developer was shaken for fifteen seconds after which the charge distribution of the toner was measured in a Xerox Corporation toner charge spectrograph apparatus. The charge spectrum exhibited a single narrow peak indicating that the added 1.0 weight percent of uncharged toner had admixed with the incumbent toner in 15 seconds or less. The toner average charge distribution (Q/D) was 0.60 fC/micron, wherein Q is the charge on the toner particles or particle, and D is the diameter of the particle or particles. The width of the distribution as determined by the standard deviation of Q/D divided by Q/D was 0.689. The aforementioned developer composition was used to develop latent images generated in a Xerox Corporation MICR 4135® test printer apparatus, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate and the images were fused to paper for about 1.4 million copies, each with from 4 to 30 percent area coverage. Furthermore, this test was conducted under temperature and humidity conditions of 60° F. to 80° F., and 20 to 80 percent relative humidity. The developer charging properties remained essentially constant throughout the test, that is for example, for about 1.0 million copies, as determined by periodic measurements of toner triboelectric charge and toner concentration in the developer. The values of, for example, $A_t$ remained constant, about 92, throughout this test as determined from the following calculation, that is the product of one plus the toner concentration (TC) multiplied by the charge Q/M, for example 23 microcoulombs per gram. $A_t=(1+TC)\times Q/M$ The fused images, that is personal checks with magnetic characters thereon, were of excellent quality, that is the check characters had high optical densities of greater than 1.3 (solid area image optical density) as measured on a Macbeth Densitometer and very low development of toner in background areas, that is minimum background deposits. Periodic visual microscopic inspection of the photoreceptor indicated no evidence of toner impacting onto the photoreceptor such as in small streaks of one millimeter or less, that is there was an absence of undesirable comets for 1.4 million copies. Examination of the Xerox Corporation 41 35® test printer cleaning subsystem indicated a lack of excessive wear of components such as the detone blade. When 500 checks prepared from the aforementioned developer were passed through an IBM 3890® Reader/Sorter, toner offsetting to the protective foils on the write and read heads were absent as evidenced by visual microscopic inspection, and there was no image smearing on the checks. These checks were repeatedly passed through the IBM 3890® for an additional 19 passes after which, upon inspection of the protective foil, there was evidence of only slight contamination.

In the above Example it is possible to generate KYNAR® agglomerates which, because of their charge, tend to end up located on the background area of the photoreceptor, and are subsequently transferred and fused to the non-print areas of the paper. The additive agglomerate frequently is frequently covered with toner, thus giving the agglomerates the appearance of black spots or background deposits in non image areas.

EXAMPLE I

Comparative Example I was repeated with the exception that PMMA submicron particles with a nominal molecular weight of about 100,000 and nominal particle size of about 0.44 microns (Soken Chemicals) were used in place of the KYNAR® surface additive particles, with the result that there was no detectable background deposits after about from 100,000 to about 400,000 copies or impressions.

In this Example there is less tendency to generate PMMA agglomerates which are located on the background area of the photoreceptor. The toner processing tends to create less agglomerates. Any agglomerates that are present in the toner do not end up in the background area of the photoreceptor, instead they are attracted to the charged image area on the photoreceptor. The non-print areas tend to have considerably less background toner additive agglomerates compared to the KYNAR® containing toner.

Table 1 below provides a TC Latitude comparison of toners prepared with PMMA of the present invention with toners prepared with KYNAR®.

TABLE 1

Toner Concentration Latitude (TCL) comparison of PMMA toners and KYNAR ® toners

| Toner | External Additive | Additive (wt. %) | TC Limit SAD[1] | TC Limit BKG[2] | Total TCL[3] |
|---|---|---|---|---|---|
| Comp Ex I | KYNAR ® | 0.5 | 2.1 | 3.5 | 1.4 |
| Example I | PMMA | 0.5 | 1.3 | 6.0 | 4.7 |

[1]Solid Area Density - toner concentration limit.
[2]Background - toner concentration limit.
[3]Total TCL = TC (BKG) − TC (SAD)

Other modifications of the present invention may occur to one of ordinary skill in the art based upon a review of the present application and these modifications, including equivalents thereof, are intended to be included within the scope of the present invention.

What is claimed is:

1. A toner comprised of toner particles consisting essentially of a melt mixture of resin particles, an internal charge additive, and an internal release agent, wherein the toner resin is a styrene-butadiene copolymer with a weight average molecular weight of about 100,000 to about 400,000 in an amount of from about 55 to about 70 weight percent, the colorant is mixture of an acicular magnetite in an amount of from about 27 to about 34 weight percent and carbon black in an amount of from about 2 to about 3 weight percent based on the total weight of the toner composition, wherein the internal charge additive is quaternary ammonium salt in an amount of from about 0.7 to about 1.5 weight percent, wherein the internal release agent is a low molecular weight wax with a weight average molecular weight of from about 1,000 to about 3,000 in an amount of from about 4.5 to about 6 weight percent; and the surface of the toner particles consists of a mixture of a hydrophobic silica flow aid compound in an amount of from about 0.75 to about 1.0 weight percent, strontium titanate in an amount of from about 0.5 to about 1.25 weight percent, and polymethylmethacrylate surface additive particles electrostatically adhering to the surface of said toner particles in an amount of from about 0.25 to about 0.75 weight percent based on the total weight of the toner, wherein the toner has a net positive charging character, and wherein the background deposits (BKG) and solid area development (SAD) components of the machine toner concentration latitude of said toner composition is in the range of about 4 to about 5 units compared to a range of about 1 to about 1.5 units for a toner without said polymethylmethacrylate particles on the surface of the toner.

2. A toner in accordance with claim 1, wherein the acrylate polymer particles are polyacrylate polymers, polyacrylate copolymers, or mixtures thereof.

3. A toner in accordance with claim 1, wherein the acrylate polymer particles are comprised of polymethylmethacrylate.

4. A toner in accordance with claim 1, wherein the acrylate polymer particles have a volume average diameter particle size of from about 0.25 to about 0.75 microns and are uniformly distributed on the toner surface.

5. A toner in accordance with claim 1, wherein the polymethylmethacrylate polymer particles are positively charging, and the polymethylmethacrylate polymer particles are spherical in shape.

6. A toner in accordance with claim 1, wherein the toner is comprised of toner particles with a volume average diameter particle size from about 1 to about 40 microns.

7. A toner in accordance with claim 1, wherein the toner is comprised of toner particles with a volume average diameter particle size of from about 8 to about 13 microns.

8. A toner in accordance with claim 1, wherein the weight ratio of the toner particles to the polymethylmethacrylate polymer particles is from about 1,000:1 to about 10:1.

9. A toner in accordance with claim 1, wherein the colorant is a pigment and is present in an amount of from about 2 to about 10 weight percent based on the total weight of the toner, and wherein the colorant is a selected from the group consisting of a carbon black, a magnetite, a cyan pigment, a magenta pigment, a yellow pigment, a red pigment, a green pigment, a blue pigment, a brown pigment, and mixtures thereof.

10. A toner in accordance with claim 1, further comprising an external charge additive present in an amount of from about 0.05 to about 5 weight percent of the toner particles.

11. A toner in accordance with claim 1, wherein the toner has an admix time of from about 1 to about 14 seconds, and a triboelectric charge of from about 10 to about 35 microcoulombs per gram.

12. A developer composition comprised of the toner of claim 1 and carrier particles.

* * * * *